US006911115B2

(12) United States Patent
Mallol et al.

(10) Patent No.: US 6,911,115 B2
(45) Date of Patent: Jun. 28, 2005

(54) SECURITY PAPER

(75) Inventors: Stéphane Mallol, Provins (FR); Yvan Thierry, Jouy sur Morin (FR)

(73) Assignee: Arjowiggins Security, Moulineaux (FR)

( * ) Notice: Subject to any disclaimer, the term of this patent is extended or adjusted under 35 U.S.C. 154(b) by 0 days.

(21) Appl. No.: 10/181,727

(22) PCT Filed: Feb. 1, 2001

(86) PCT No.: PCT/FR01/00308

§ 371 (c)(1),
(2), (4) Date: Sep. 3, 2002

(87) PCT Pub. No.: WO01/57312

PCT Pub. Date: Aug. 9, 2001

(65) Prior Publication Data

US 2003/0056914 A1 Mar. 27, 2003

(30) Foreign Application Priority Data

Feb. 1, 2000 (FR) ..... 00 01249

(51) Int. Cl.[7] ..... D21F 11/00; D21H 27/02
(52) U.S. Cl. ..... 162/116; 162/140; 428/916
(58) Field of Search ..... 162/116, 140, 162/903; 428/916; 283/72, 113

(56) References Cited

U.S. PATENT DOCUMENTS

| | | | | |
|---|---|---|---|---|
| 4,210,346 A | | 7/1980 | Mowry, Jr. et al. | |
| 4,462,866 A | * | 7/1984 | Tooth et al. | 162/140 |
| 4,462,867 A | * | 7/1984 | Fuller | 162/103 |
| 4,600,629 A | | 7/1986 | Knapp et al. | |
| 5,161,829 A | | 11/1992 | Detrick et al. | |
| 5,275,870 A | | 1/1994 | Halope et al. | |
| 5,388,862 A | | 2/1995 | Edwards | |
| 5,678,863 A | | 10/1997 | Knight et al. | |
| 5,830,609 A | | 11/1998 | Warner et al. | |
| 5,883,043 A | | 3/1999 | Halbrook, Jr. et al. | |
| 5,928,471 A | | 7/1999 | Howland et al. | |
| 5,932,071 A | | 8/1999 | Stielow et al. | |
| 5,961,432 A | * | 10/1999 | Murakami et al. | 493/187 |
| 6,063,239 A | * | 5/2000 | Howland et al. | 162/110 |
| 6,355,140 B1 | * | 3/2002 | Murakami et al. | 162/140 |
| 6,402,888 B1 | * | 6/2002 | Doublet et al. | 162/140 |
| 6,630,055 B1 | | 10/2003 | Goguelin et al. | |

FOREIGN PATENT DOCUMENTS

| | | |
|---|---|---|
| EP | 0 773 320 A1 | 5/1997 |
| FR | 2 723 971 A1 | 3/1996 |
| FR | 2 769 927 A1 | 10/1997 |
| WO | WO 94/20679 | 9/1994 |

OTHER PUBLICATIONS

U.S. Appl. No. 09/764,096, filed Jan. 19, 2001.

* cited by examiner

*Primary Examiner*—Peter Chin
(74) *Attorney, Agent, or Firm*—Oliff & Berridge, PLC

(57) ABSTRACT

Security paper (1) has a security zone (2) for providing protection against mechanical falsification. The security zone comprises a set of cells (3) indented in the paper and optionally interconnected by indented link portions, the thickness of the paper being substantially uniform throughout its area that is complementary to the cells (3) and to the link portions in the security zone (2).

32 Claims, 2 Drawing Sheets

SECURITY PAPER

BACKGROUND OF THE INVENTION

The present invention relates to security paper having a security zone, to a method of making such paper, and to apparatus for implementing the method.

It is known to make weakened zones in sheets of paper that are to constitute security documents, such as, for example, bank bills, means of payment, identity documents, travel tickets, or tickets for entry to cultural or sporting events. These zones are intended to receive information that must not be falsified.

The weak zone is designed in such a manner that any mechanical attack applied to its surface will give rise to irreversible damage, such as puncturing the paper or making its surface fluffy, thus making it impossible to alter any information that has already been marked in said weak zone.

One known method of making a weak zone is to apply abrasion or shaving down to half-depth in the zone, after the sheet of paper has been made, as proposed in document EP-A-0 543 528.

Making the weak zone requires an additional operation compared with the normal process of making paper, and that gives rise to extra cost that is relatively high.

Furthermore, the additional operation is difficult to industrialize, and document EP-A-0 543 528 does not provide any precise teaching on this topic.

Another known method is to form two layers of paper simultaneously by the dual-web technique, one of the layers being provided with a window where the other one does not have a window. The assembled-together layers thus provide a sheet of paper provided with a window of reduced thickness and considerable weakness.

The sheet made using the dual-web technique presents the drawback that its weak zone needs to be sufficiently weak to perform its security function while nevertheless being capable of standing up to the handling involved in industrial manufacture of the sheet. The paper manufacturer thus needs to find a good compromise between those two requirements.

Furthermore, the weak zone cannot extend over a large area since otherwise it is in danger of tearing on first use, i.e. when being used as security paper.

All of those known security papers are also vulnerable to the method of falsification that consists in shaving away a part of the thickness of the security zone and covering the remaining thickness with some other, falsified sheet, e.g. using adhesive.

SUMMARY OF THE INVENTION

The present invention seeks to provide security paper that has a security zone, and that is simple and inexpensive to make.

The present invention thus provides security paper having a security zone for providing protection against mechanical falsification, the paper being characterized by the fact that said security zone comprises a set of cells formed as indentations in the paper, optionally interconnected by indented link portions, the thickness of the paper being substantially uniform throughout its area that is complementary to the cells and to the link portions in said security zone.

In the security paper of the invention, the security zone is indeed somewhat weaker than the remainder of the paper, but not to such an extent as to endanger the integrity of the paper.

The portions of paper situated between the cells constitute reinforcement for the security zone so that even if it occupies a large area, the reinforcement ensures that it is sufficiently strong. The security zone can thus occupy a large fraction of the sheet.

When the security zone is printed, the role of the cells is not only to weaken the paper, but also to form traps for the ink that marks the information carried by the security zone.

Once the ink has become housed in the cells, it is difficult to reach, whether by scratching or by means of an eraser.

Providing the cells formed in the paper are deep enough, the invention also solves the problem mentioned above of falsification by removing a layer from the thickness of the security zone in the paper.

Even when a layer of thickness has been removed from the security zone, the bottoms of the cells in the security zone continue to contain ink that was deposited when marking the security information.

The cells may be distributed in an array.

The security zone may have 1 to 20, and preferably 2 to 10 cells per square centimeter ($cm^2$).

The area occupied by the cells, and by the linking portions if any, corresponds to at least 50% of the total area of the security zone.

By way of example, the depth of the cells lies in the range 50% to 90% and preferably in the range 70% to 80% of the maximum thickness of the paper around the cells in the security zone.

All of the cells may be of substantially the same depth.

The paper obtained by means of the invention presents the advantage of not needing to have any projecting portions such as embossing or tooling, and this is particularly advantageous for printing operations, both in the security zone and over the remainder of the surface.

In particular, tests performed by the Applicant have revealed that the paper of the invention presents no difficulty when it is printed with ink, including in the security zone, where the ink becomes deposited in the bottoms of the cells.

Those tests have shown that printing is of good quality when performed by ink jet printing and also when performed by laser printing.

In particular, it is possible to print a photograph in the security zone without needing to take any precaution because of the presence of the cells, and with the guarantee that the photograph can be falsified or eliminated only with great difficulty.

In addition, in the paper of the invention, each cell gives the paper a fiber composition weight per unit area that is less that that of the paper around the cell. Each cell can thus be more transparent than its immediate vicinity, in the absence of ink.

As a result, by spreading the cells over the surface of the security zone like the dots in a half-tone image, e.g. by varying the shape, the number, and/or the size, and/or the distribution of the cells in different portions of the security zone, it is possible to obtain a macroscopic effect that constitutes a multi-tone effect watermark.

Thus, the cells, and the connecting portions if any, constitute pale zones in the paper when it is observed in transmitted light prior to printing, with said pale zones being outlined by dark zones.

The pale zones and the dark zones advantageously define a half-tone image.

Preferably, the half-time image presents a screen of spots constituted by lines.

Also preferably, the pale zones are not disjoint, thus making it possible to provide a watermark by means of a one-piece perforated grid, as described below.

Finally, because sheets of paper need not have any projecting portions or embossing, they can be processed without it being necessary to provide spacers to compensate for local increases in thickness.

The paper of the invention is particularly simple to make by means of the method also provided by the present invention, which method is characterized by the fact that the method includes the step consisting in providing a wire for use during the wet stage of paper-making with a set of masks suitable for creating a set of cells formed in the thickness of the paper in a zone of the paper that lies in register with the masks while the paper is being made.

The present invention also provides a wire for use in the wet stage of paper manufacture, which wire is characterized by the fact that it is provided with a set of masks which create a set of cells formed in the thickness of the paper in a zone of the paper that lies in register with the masks while the paper is being made.

The above-mentioned set of marks serves to obtain indentations in a zone of the paper constituting the security zone.

These indentations are formed in the paper because of the marks which are present on the wire restrict accumulation of the cellulose, synthetic, or inorganic fibers that are present in the aqueous suspension used for making the paper.

The corresponding portions of the paper constitute the cells while the remainder of the paper, and in particular the regions that are formed between the masks of the array presents thickness that is substantially equal to the thickness of paper where there are no cells.

In a first embodiment of the invention, the wire in question constitutes the paper-making wire.

In a second embodiment, the wire in question is used for lifting the formed sheet.

In a third embodiment, the wire in question is fixed to a wet press which works on the still-wet sheet after it has been lifted.

In a fourth embodiment, the wire in question is fixed to a watermarking roll.

In a fifth embodiment of the invention, the wire in question is fixed to a graining element situated outside the sheet-forming zone.

By way of example, the wire may be located on a cylinder machine or on an endless-wire machine.

In each of the above-described embodiments, the set of marks may be located on the inside face of the wire, in its thickness, or on the outside face of the wire, and it is possible for a plurality of wires to be associated with one another.

The array of marks is preferably situated on one of the faces of the wire rather than in its thickness.

The invention also provides a stack of wires in which at least one of the wires is a wire as described above.

Naturally, any combination of the above-described embodiments could also be used.

Various embodiments of the set of masks of the invention are described below.

In a first embodiment, the set of masks is constituted by a one-piece grid, made from a thin plate, in which perforations have been made, e.g. of hexagonal shape and disposed in a regular array. The portions of the grid that remain between the perforations constitute the masks of the array.

The density of the perforations is determined by the person skilled in the art as a function of the weight of the paper and its composition. An advantageous compromise needs to be found between the desire to obtain as large a possible an area of cells and the need for the security zone to maintain structure constituted by the reinforcement formed by those portions of the paper that surround the cells.

By way of example, the person skilled in the art might chose a large number of small cells so that the total surface area of the cells is large without weakening the reinforcement.

In addition, this solution improves the protection afforded to the ink that is received in the bottoms of the cells, since the small size of the cells makes it difficult to access the ink.

In a second embodiment, the set of masks is constituted by juxtaposing small pieces that are fixed individually to the wire.

In a particular embodiment, at least some of the masks are shaped to constitute a particular pattern for personalizing the sheet of paper, by creating cells in the thickness thereof that reproduce the pattern of the masks. For example, each pattern may form a letter or a set of letters that could be characteristic of the issuer of the security document made using the sheet of the invention.

In another particular embodiment, the set of masks, whether constituting a grid or not, itself forms a particular pattern, because of the way in which the masks are arranged or because of local changes in the shape or size of the masks at particular locations of the array.

It is thus possible, for the purpose of personalizing the document, to cause a pattern to appear underlying the information that is printed on the security zone.

The set of masks may be obtained from a half-tone image, and it may reproduce a range of tones on the paper by juxtaposing pale zones and dark zones.

Such a half-tone image advantageously has a screen of spots that are in the form of lines, said lines being of width that varies along their length, and possibly even being interrupted in certain locations, said lines also being arranged in such a manner that no completely isolated portions of line exist; a grid can easily be made by photo-etching from such an image, with the openings in the grid corresponding to the dark zones in the watermark.

BRIEF DESCRIPTION OF THE DRAWINGS

In order to make the invention better understood, there follows a description of embodiments given as non-limiting examples and made with reference to the accompanying drawings, in which.

DETAILED DESCRIPTION OF EXEMPLARY EMBODIMENTS

Figure 1:
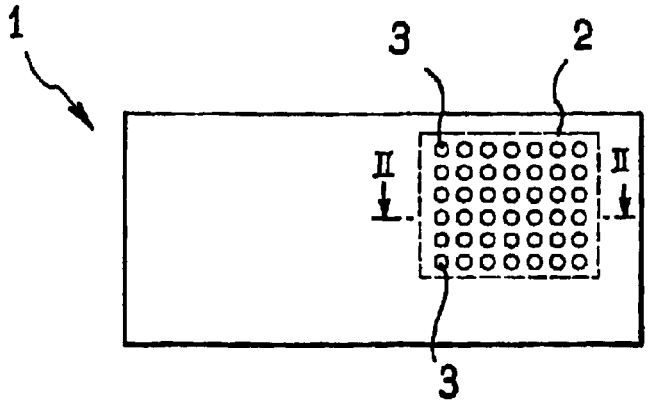
FIG. 1 is a highly diagrammatic representation of security paper such as a bank bill including a security zone of the invention.

FIG. 1 shows a security document 1 such as bank bill made using cellulose fibers and including a security zone 2 that is represented by a dashed-line rectangle.

The size of the security zone 2 can be arbitrary, and by way of example it can extend over the entire area of the document or over only a portion of the document, as is the case in the example shown.

The security zone 2 comprises an array of cells 3.

Figure 2:
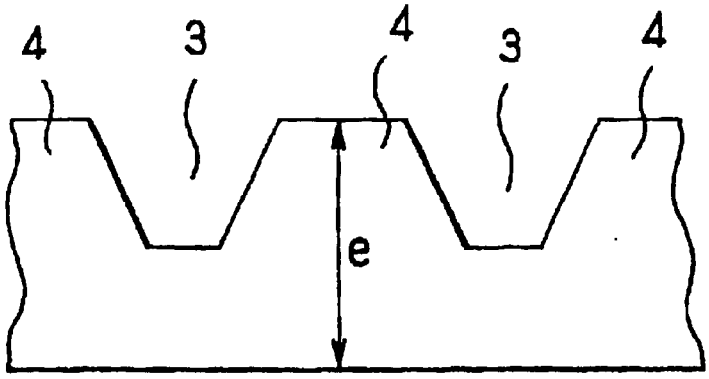
FIG. 2 is a fragmentary and diagrammatic section on section line II—II of FIG. 1.

Each cell 3 is indented in the thickness of the document 1, as can be seen in FIG. 2.

Within the security zone 2, the thickness of the paper in the regions 4 surrounding the cells 3 is substantially constant and equal to the thickness of the paper outside the security zone 2.

The weight of the paper per unit area in the cells 3 is less than the weight of the paper in above-mentioned regions 4.

Within the security zone 2, at least before the paper is printed, the cells 3 appear to be pale while the regions 4 appear to be darker than the cells 3.

Figure 3:
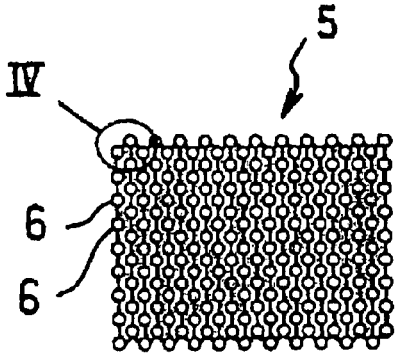
FIG. 3 shows an array of masks in accordance with the invention.
Figure 4:
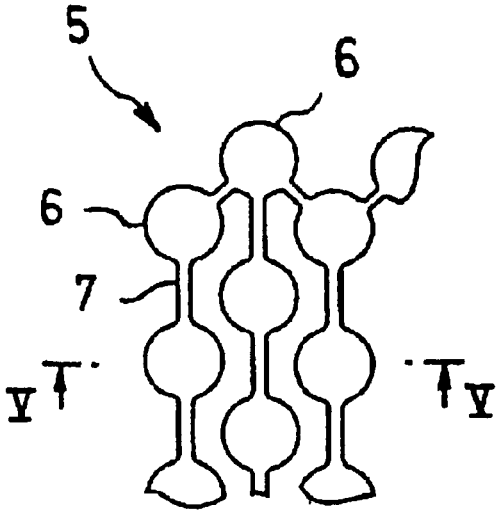
FIG. 4 shows a detail of FIG. 3.
Figure 5:
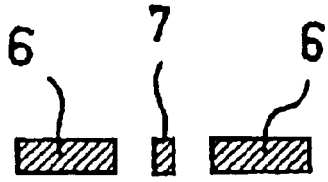
FIG. 5 is a section on section line V—V of FIG. 4.

To make the cells 3, an array 5 of individual masks 6 is used, such as that shown in FIG. 3.

The individual masks 6 are interconnected by narrow bridges 7.

The array 5 is made as a single piece, e.g. by cutting or etching a thin plate of metal or of plastics material.

Figure 6:
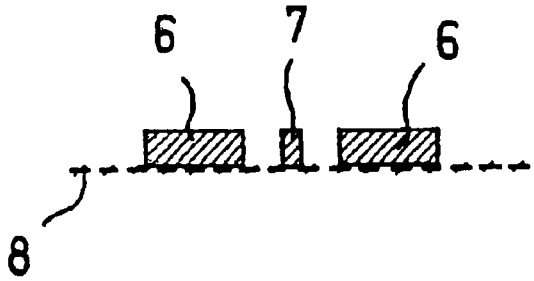
FIG. 6 is a diagrammatic section through a wire carrying an array of masks in accordance with the invention.

The array 5 is used together with a wire 8 that is shown diagrammatically in FIG. 6, said wire 8 being constituted for example by a conventional wire of the kind used in conventional manner during the wet stage of making paper from an aqueous suspension of cellulose fibers.

As in the example described, the array 5 is preferably constituted by a metal grid fixed on the outside face of the wire 8, i.e. the face which comes into contact with the aqueous suspension of cellulose fibers.

While the paper is being made, each individual mask 6 restricts the amount of cellulose fibers in suspension that can accumulate on the wire, thereby creating a cell in the zone of the paper that lies in register with an individual mask.

The bridges 7 provide indented link portions in the sheet, which are not shown in FIG. 1 in order to clarify the drawing.

When the individual masks 6 and the link portions 7 are made as a single piece, there are no indented portions in the security zone that are isolated from the others.

Naturally, the invention is not limited to this particular embodiment.

Specifically, the grid could be fixed to a wire that is not used directly for making paper, but that is used, for example, for lifting a sheet that has just been made.

It is also possible to fix the grid to a wire that forms part of a wet press that operates on a still-wet sheet while it is being lifted, or on a wire that is fixed to a watermarking roll, or indeed to a wire that is fixed to a graining element situated outside the sheet-forming zone.

It is also possible to make the array of masks in the thickness of the wire by locally obstructing its pores.

The security zone of the resulting sheet can be printed using known printing techniques, in particular laser printing with any type of ink, whether visible in daylight or fluorescent.

The resulting image is difficult to erase since the ink remains held captive in the bottoms of the cells.

The array 5 of masks may be replaced in a variant embodiment (not shown) by a grid that has perforations, said grid being obtained from a half-tone image.

What is claimed is:

1. Security paper comprising a security zone for providing protection against mechanical falsification, said security zone extending over a portion only of the security paper and comprising a set of cells formed by indentations in the paper and interconnected by indented link portions, the thickness of the paper being substantially uniform throughout an area of said security zone that is complementary to the cells and to the link portions.

2. Paper according to claim 1, wherein the security zone comprises 1 to 20 cells per $cm^2$.

3. Paper according to claim 1, wherein the area occupied by the cells and the link portions constitutes at least 50% of the total area of the security zone.

4. Paper according to claim 1, wherein the depth of the cells lies in the range 50% to 90% of the maximum thickness of the paper around the cells in the security zone.

5. Paper according to claim 1, wherein the cells are of substantially the same depth with each other.

6. Paper according to claim 1, wherein the cells are distributed in a regular array.

7. Paper according to claim 1, wherein the cells and the link portions constitute pale zones in the paper when observed in transmitted light prior to printing, said pale zones being outlined by dark zones.

8. Paper according to claim 7, wherein the pale zones and the dark zones define a half-tone image.

9. Paper according to claim 8, wherein the half-tone image presents a screen of spots constituted by lines.

10. Paper according to claim 7, wherein the pale zones are not disjoint.

11. Paper according to claim 1 wherein the security zone is printed so that the ink is deposited in bottoms of the cells.

12. Paper according to claim 11, wherein the printing is laser printing.

13. Paper according to claim 1, wherein the security zone comprises 2 to 10 cells per $cm^2$.

14. Paper according to claim 1, wherein the depth of the cells lies in the range of 70% to 80% of the maximum thickness of the paper around the cells in the security zone.

15. Paper according to claim 1, comprising a single layer of paper.

16. A method of making a sheet of paper having a security zone for providing protection against mechanical falsification and extending over a portion only of the security paper, comprising providing a wire for use during a wet stage of paper-making with a set of masks configured for creating a set of cells formed in the thickness of the paper in a zone of the paper that lies in register with the masks while the paper is being made, and link portions interconnecting the cells.

17. Security paper comprising a security zone for providing protection against mechanical falsification, said security zone extending over a portion only of the security paper and comprising a set of cells formed by indentations in the paper, the cells being distributed in a regular bidimensional array.

18. Paper according to claim 17, wherein the cells are interconnected by indented link portions.

19. Paper according to claim 18, wherein the thickness of the paper is substantially uniform throughout an area of the security zone that is complementary to the cells and to the link portions.

20. Paper according to claim 18, wherein the cells and link portions constitute pale zones in the paper when observed in transmitted light prior to printing, said pale zones being outlined by dark zones.

21. Paper according to claim 20, wherein the pale zones and the dark zones define a half-tone image.

22. Paper according to claim 21 wherein the half-tone image presents a screen of spots constituted by lines.

23. Paper according to claim 20, wherein the pale zones are not disjoint.

24. Paper according to claim 17, wherein the security zone comprises 1 to 20 cells per $cm^2$.

25. Paper according to claim 17, comprising a single layer of paper.

26. Security paper comprising a security zone for providing protection against mechanical falsification, said security zone extending over a portion only of the security paper and comprising a set of cells formed by indentations in the paper, the security zone being printed so that ink is deposited in bottoms of the cells.

27. Paper according to claim 26, wherein the cells are interconnected by indented link portions.

28. Paper according to claim 27, wherein the thickness of the paper is substantially uniform throughout an area of the security zone that is complementary to the cells and to the link portions.

29. Paper according to claim 26, wherein the printing is laser printing.

30. Paper according to claim 26, comprising a single layer of paper.

31. A method of making a sheet of paper having a security zone for providing protection against mechanical falsification and extending over a portion only of the security paper, comprising providing a wire for use during a wet stage of paper-making with a set of masks configured for creating a set of cells formed in the thickness of the paper in a zone of the paper that lies in register with the masks while the paper is being made, the set of cells being distributed in a bidimensional regular array.

32. A method of making a sheet of paper having a security zone for providing protection against mechanical falsification and extending over a portion only of the security paper, comprising providing a wire for use during a wet stage of paper-making with a set of masks configured for creating a set of cells formed in the thickness of the paper in a zone of the paper that lies in register with the masks while the paper is being made, the method further comprising the step consisting in printing the security zone so that the ink is deposited in bottoms of the cells.

* * * * *